US010410615B2

(12) United States Patent
Zhao

(10) Patent No.: US 10,410,615 B2
(45) Date of Patent: Sep. 10, 2019

(54) AUDIO INFORMATION PROCESSING METHOD AND APPARATUS

(71) Applicant: TENCENT TECHNOLOGY (SHENZHEN) COMPANY LIMITED, Shenzhen, Guangdong (CN)

(72) Inventor: Weifeng Zhao, Guangdong (CN)

(73) Assignee: TENCENT TECHNOLOGY (SHENZHEN) COMPANY LIMITED, Shenzhen, Guangdong (CN)

( * ) Notice: Subject to any disclaimer, the term of this patent is extended or adjusted under 35 U.S.C. 154(b) by 0 days.

(21) Appl. No.: 15/762,841

(22) PCT Filed: Mar. 16, 2017

(86) PCT No.: PCT/CN2017/076939
§ 371 (c)(1),
(2) Date: Mar. 23, 2018

(87) PCT Pub. No.: WO2017/157319
PCT Pub. Date: Sep. 21, 2017

(65) Prior Publication Data

US 2018/0293969 A1 Oct. 11, 2018

(30) Foreign Application Priority Data

Mar. 18, 2016 (CN) ..... 2016 1 0157251

(51) Int. Cl.
*G10H 1/36* (2006.01)
*G10H 1/12* (2006.01)
(Continued)

(52) U.S. Cl.
CPC ..... *G10H 1/361* (2013.01); *G10H 1/125* (2013.01); *G10H 1/36* (2013.01);
(Continued)

(58) Field of Classification Search
CPC ..... H04S 2400/01; G10H 2210/031; G10H 2210/056; G10H 2210/076; G10H 1/36; G10H 1/361; G10H 2210/005
See application file for complete search history.

(56) References Cited

U.S. PATENT DOCUMENTS 5,719,344 A * 2/1998 Pawate ..... G10H 1/361 434/307 A
5,736,943 A * 4/1998 Herre ..... G10L 19/008 341/106
(Continued)

FOREIGN PATENT DOCUMENTS

CN 101577117 A 11/2009
CN 101894559 A 11/2010
(Continued)

OTHER PUBLICATIONS

Eric's Memo Pad, "KTV Automatic Sound Channel Judgment", http://ericpeng1968.blogspot.com/2015/08/ktv_5.html, Aug. 5, 2015.
(Continued)

*Primary Examiner* — Marlon T Fletcher
(74) *Attorney, Agent, or Firm* — Sughrue Mion, PLLC

(57) ABSTRACT

An audio information processing method and apparatus are provided. The method includes decoding a first audio file to acquire a first audio subfile corresponding to a first sound channel and a second audio subfile corresponding to a second sound channel; extracting first audio data from the first audio subfile; extracting second audio data from the second audio subfile; acquiring a first audio energy value of the first audio data; acquiring a second audio energy value of the second audio data; and determining an attribute of at least one of the first sound channel and the second sound channel based on the first audio energy value and the second audio energy value.

20 Claims, 7 Drawing Sheets

(51) Int. Cl.

| | |
|---|---|
| *G10L 25/12* | (2013.01) |
| *G10L 25/18* | (2013.01) |
| *G10L 25/21* | (2013.01) |
| *G10L 25/30* | (2013.01) |

(52) U.S. Cl.

CPC . *G10H 2210/005* (2013.01); *G10H 2210/041* (2013.01); *G10H 2210/056* (2013.01); *G10H 2230/025* (2013.01); *G10H 2250/071* (2013.01); *G10H 2250/275* (2013.01); *G10H 2250/311* (2013.01); *G10L 25/12* (2013.01); *G10L 25/18* (2013.01); *G10L 25/21* (2013.01); *G10L 25/30* (2013.01)

(56) References Cited

U.S. PATENT DOCUMENTS

| | | | | |
|---|---|---|---|---|
| 7,630,500 | B1 * | 12/2009 | Beckman | H04S 7/30 381/18 |
| 8,378,964 | B2 * | 2/2013 | Ullrich | G06F 3/16 345/156 |
| 8,489,403 | B1 * | 7/2013 | Griffin | G10L 19/008 375/260 |
| 2004/0074378 | A1 * | 4/2004 | Allamanche | G10H 1/0008 84/616 |
| 2004/0094019 | A1 * | 5/2004 | Herre | G10H 1/40 84/611 |
| 2004/0125961 | A1 * | 7/2004 | Alessio | G10L 25/78 381/56 |
| 2007/0131095 | A1 * | 6/2007 | Park | G10H 1/0008 84/609 |
| 2007/0180980 | A1 * | 8/2007 | Kim | G10H 1/40 84/612 |
| 2008/0187153 | A1 * | 8/2008 | Lin | G10L 19/005 381/94.7 |
| 2011/0081024 | A1 * | 4/2011 | Soulodre | G01S 3/8006 381/17 |
| 2013/0121511 | A1 * | 5/2013 | Smaragdis | G10L 25/48 381/119 |
| 2016/0049162 | A1 * | 2/2016 | Choi | G10L 21/0316 381/56 |
| 2016/0254001 | A1 * | 9/2016 | Paulus | G10L 19/008 381/22 |

FOREIGN PATENT DOCUMENTS

| | | | |
|---|---|---|---|
| CN | 105741835 | A | 7/2016 |
| JP | 9-16189 | A | 1/1997 |
| JP | 2003-330497 | A | 11/2003 |
| JP | 2005-201966 | A | 7/2005 |

OTHER PUBLICATIONS

International Search Report for PCT/CN2017/076939 dated Jun. 20, 2017.

Communication dated Jun. 17, 2019, from the Japanese Patent Office in counterpart application No. 2018-521411.

* cited by examiner

AUDIO INFORMATION PROCESSING METHOD AND APPARATUS

RELATED APPLICATION

This application is a National Stage entry of International Application No. PCTCN2017/076939, filed on Mar. 16, 2017, which claims priority from Chinese Patent Application No. 201610157251.X, entitled "Audio Information Processing Method and Terminal" filed on Mar. 18, 2016 to the Chinese Patent Office, which is incorporated by reference in its entirety.

FIELD OF THE TECHNOLOGY

The present application relates to the information processing technology, and in particular to an audio information processing method and apparatus.

BACKGROUND OF THE DISCLOSURE

Audio files with an accompaniment function generally have two sound channels: an original sound channel (having accompaniments and human voices) and an accompanying sound channel, which are switched by a user when he or she is singing Karaoke. Since there is no fixed standard, the audio files acquired from different channels have different versions, the first sound channel of some audio files is an accompaniment while the second sound channel of other audio files is an accompaniment. Thus it is not possible to confirm which sound channel is the accompanying sound channel after these audio files are acquired. Generally, the audio files may be put into use only after being adjusted to a uniform format by artificial recognition or by being automatically resolved by equipment.

However, an artificial filtering method is low in efficiency and high in cost, and an equipment resolution method is low in accuracy because a large number of human-voice accompaniments exist in many accompanying audios. At present, there is no effective solution to the above problems.

SUMMARY

It may be an aspect to provide an audio information processing method and apparatus, which can distinguish the corresponding accompanying sound channel of an audio file efficiently and accurately.

According to an aspect of one or more exemplary embodiments, there is provided a method comprising decoding a first audio file to acquire a first audio subfile corresponding to a first sound channel and a second audio subfile corresponding to a second sound channel; extracting first audio data from the first audio subfile; extracting second audio data from the second audio subfile; acquiring a first audio energy value of the first audio data; acquiring a second audio energy value of the second audio data; and determining an attribute of at least one of the first sound channel and the second sound channel based on the first audio energy value and the second audio energy value.

According to an aspect of one or more exemplary embodiments, there is provided an apparatus comprising at least one memory configured to store computer program code; and at least one processor configured to access the at least one memory and operate according to the computer program code, said computer program code including decoding code configured to cause at least one of the at least one processor to decode an audio file to acquire a first audio subfile corresponding to a first sound channel and a second audio subfile corresponding to a second sound channel; extracting code configured to cause at least one of the at least one processor to extract first audio data from the first audio subfile and second audio data from the second audio subfile; acquisition code configured to cause at least one of the at least one processor to acquire a first audio energy value of the first audio data and a second audio energy value of the second audio data; and processing code configured to cause at least one of the at least one processor to determine an attribute of at least one of the first sound channel and the second sound channel based on the first audio energy value and the second audio energy value.

According to an aspect of one or more exemplary embodiments, there is provided a non-transitory computer-readable storage medium that stores computer program code that, when executed by a processor of a calculating apparatus, causes the calculating apparatus to execute a method comprising decoding an audio file to acquire a first audio subfile outputted corresponding to a first sound channel and a second audio subfile outputted corresponding to a second sound channel; extracting first audio data from the first audio subfile; extracting second audio data from the second audio subfile; acquiring a first audio energy value of the first audio data; acquiring a second audio energy value of the second audio data; and determining the attribute of at least one of the first sound channel and the second sound channel based on the first audio energy value and the second audio energy value.

BRIEF DESCRIPTION OF THE DRAWINGS

The above and other aspects will become more apparent from the following description along with the accompanying drawings, in which.

DESCRIPTION OF EMBODIMENTS

Figure 1:
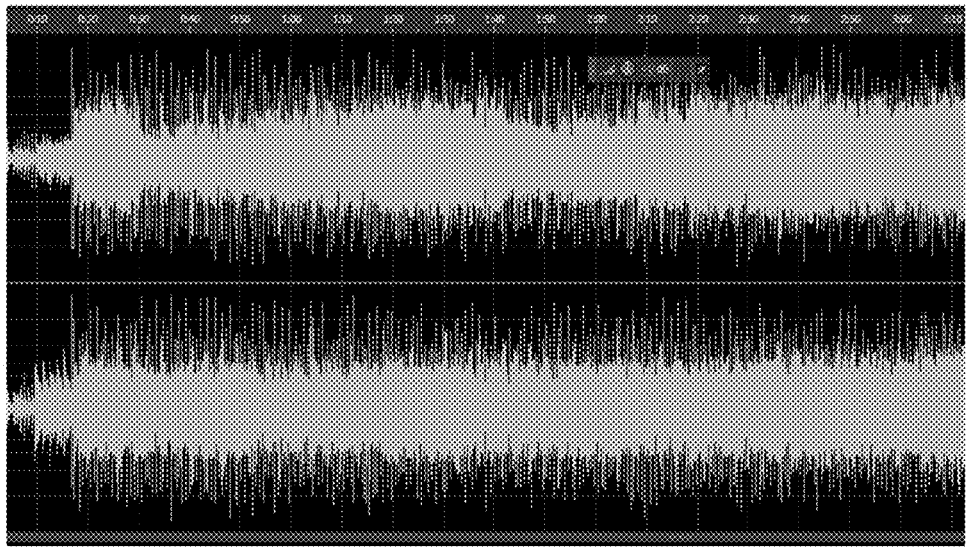
FIG. 1 is a schematic diagram of dual channel music to be distinguished.

In related art technology, automatically distinguishing a corresponding accompanying sound channel of an audio file by equipment is mainly realized through training a Support Vector Machine (SVM) model or a Gaussian Mixture Model (GMM). A distribution gap of the dual-channel audio spectrum is small, as shown in FIG. 1, a large number of human-voice accompaniments exist in many accompanying audios, thus the resolution accuracy is not high.

Exemplary embodiments acquire the corresponding first audio subfile and second audio subfile by dual-channel decoding of the audio file, then extract the audio data including the first audio data and the second audio data (the first audio data and the second audio data may have a same attribute), and finally determine an attribute of at least one of the first sound channel and the second sound channel based on the first audio energy value and the second audio energy value, so as to determine a sound channel that meets particular attribute requirements. In this way, the corresponding accompanying sound channel and original sound channel of the audio file may be distinguished efficiently and accurately, thus solving the problem of high human cost and low efficiency of manpower resolution and low accuracy of equipment automatic resolution.

An audio information processing method according an exemplary embodiment may be achieved through software, hardware, firmware or a combination thereof. The software may be, for example, WeSing software, that is, the audio information processing method provided by the present application may be used, for example, in the WeSing software. Exemplary embodiments may be applied to distinguish the corresponding accompanying sound channel of the audio file automatically, quickly and accurately based on machine learning.

Exemplary embodiments decode an audio file to acquire a first audio subfile outputted corresponding to the first sound channel and a second audio subfile outputted corresponding to a second sound channel; extract first audio data from the first audio subfile and second audio data from the second audio subfile; acquire a first audio energy value of the first audio data and a second audio energy value of the second audio data; and determine an attribute of at least one of the first sound channel and the second sound channel based on the first audio energy value and the second audio energy value so as to determine a sound channel that meets particular attribute requirements.

The following further describes various exemplary embodiments in more detail with reference to the accompanying drawings.

Exemplary Embodiment 1

Figure 2:
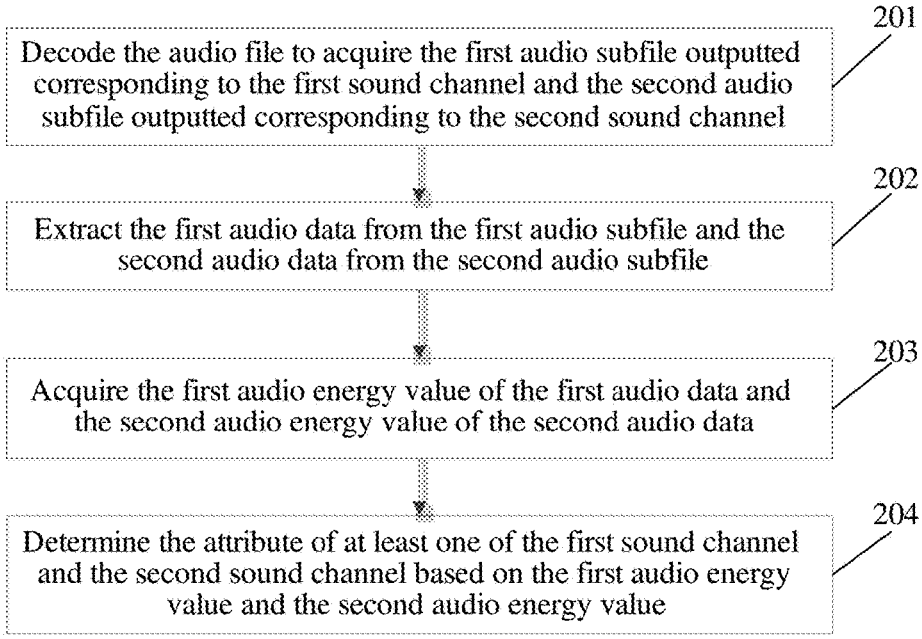
FIG. 2 is a flow diagram of an audio information processing method according an exemplary embodiment.

FIG. 2 is a flow diagram of the audio information processing method according an exemplary embodiment. As shown in FIG. 2, the audio information processing method according an exemplary embodiment may include the following steps:

Step S201: Decode the audio file to acquire the first audio subfile outputted corresponding to the first sound channel and the second audio subfile outputted corresponding to the second sound channel.

The audio file herein (also denoted as a first audio file) may be any music file whose accompanying/original sound channels are to be distinguished. The first sound channel and the second sound channel may be the left channel and the right channel respectively, and correspondingly, the first audio subfile and the second audio subfile may be the accompanying file and the original file corresponding to the first audio file respectively. For example, a song is decoded to acquire the accompanying file or original file representing the left channel output and the original file or accompanying file representing the right channel output.

Step S202: Extract the first audio data from the first audio subfile and the second audio data from the second audio subfile.

The first audio data and the second audio data may have the same attribute, or the two may represent the same attribute. If the two are both human-voice audios, then the human-voice audios are extracted from the first audio subfile and the second audio subfile. The specific human-voice extraction method may be any method that may be used to extract human-voice audios from the audio files. For example, during actual implementation, a Deep Neural Networks (DNN) model may be trained to extract human-voice audios from the audio files, for example, when the first audio file may be a song, if the first audio subfile may be an accompanying audio file and the second audio subfile may be an original audio file, then the DNN model is used to extract the human-voice accompanying data from the accompanying audio file and extract the a cappella data from the original audio file.

Step S203: Acquire the first audio energy value of the first audio data and the second audio energy value of the second audio data.

For example, the first audio energy value may be calculated from the first audio data and the second audio energy value may be calculated from the second audio data. The first audio energy value may be the average audio energy value of the first audio data, and the second audio energy value may be the average audio energy value of the second audio data. In practical application, different methods may be used to acquire the average audio energy value corresponding to the audio data. For example, the audio data may be composed of multiple sampling points, and each sampling point may generally correspond to a value between 0 and 32767, and the average value of all sampling point values may be taken as the average audio energy value corresponding to the audio data. In this way, the average value of all sampling points of the first audio data may be taken as the first audio energy value, and the average value of all sampling points of the second audio data may be taken as the second audio energy value.

Step S204: Determine the attribute of at least one of the first sound channel and the second sound channel based on the first audio energy value and the second audio energy value.

Determine the attribute of the first sound channel and/or the second sound channel based on the first audio energy value and the second audio energy value so as to determine a sound channel that meets particular attribute requirements, that is to determine which one of the first sound channel and the second sound channel is the sound channel that meets the particular attribute requirements. For example, determine that the first sound channel or the second sound channel is the sound channel that outputs accompanying audios based on the first audio energy value of the human-voice audio outputted by the first sound channel and the second audio energy value of the human-voice audio outputted by the second sound channel.

On the basis of the exemplary embodiment, in practical application, the sound channel that meets the particular attribute requirements may be the sound channel where the outputted audio of the first audio file is the accompanying audio in the first sound channel and the second sound channel. For example, for a song, the sound channel that meets the particular attribute requirements may be the sound channel outputting the accompaniment corresponding to the song in left and right channels.

In the process of determining the sound channel that meets the particular attribute requirements, specifically, for a song, if there are few human-voice accompaniments in the song, then correspondingly, the audio energy value corresponding to the accompanying file of the song will be small, while the audio energy value corresponding to the a cappella file of the song will be large. Therefore, a threshold (i.e. audio energy difference threshold) may be used. The audio energy difference threshold may be predetermined. Specifically, the threshold may be set, experimentally, according to the actual use. The difference value between the first audio energy value and the second audio energy value may be determined, if the result shows that the difference value is greater than the threshold and the first audio energy value is less than the second audio energy value, then determine the attribute of the first sound channel as the first attribute and the attribute of the second sound channel as the second attribute, that is to determine the first sound channel as the sound channel outputting accompanying audios and the second sound channel as the sound channel outputting original audios. On the contrary, if the difference value between the first audio energy value and the second audio energy value is greater than the threshold and the second audio energy value is less than the first audio energy value, then determine the attribute of the second sound channel as the first attribute and the attribute of the first sound channel as the second attribute, that is to determine the second sound channel as the sound channel outputting accompanying audios and the first sound channel as the sound channel outputting original audios.

In this way, if the difference value between the first audio energy value and the second audio energy value is greater than the audio energy difference threshold, then the first audio subfile or the second audio subfile corresponding to the first audio energy value or the second audio energy value (whichever is smaller) may be determined as the audio file (i.e. accompanying files) that meets the particular attribute requirements, and the sound channel corresponding to the audio subfile that meets the particular attribute requirements as the sound channel that meets the particular requirements (i.e. sound channel that outputs accompanying files).

If the difference value between the first audio energy value and the second audio energy value is not greater than the audio energy difference threshold, then there may be many human-voice accompaniments in the accompanying audio file in application. However, the frequency spectrum characteristics of accompanying audios and a cappella audios are still different, so human-voice accompanying data may be distinguished from a cappella data according to the frequency spectrum characteristics thereof. After the accompanying data is determined preliminarily, the accompanying data may be determined finally based on the principle that the average audio energy of the accompanying data is less than that of the a cappella data, and then the result that the sound channel corresponding to the accompanying data is the sound channel that meets the particular attribute requirements is obtained.

Exemplary Embodiment 2

Figure 3:
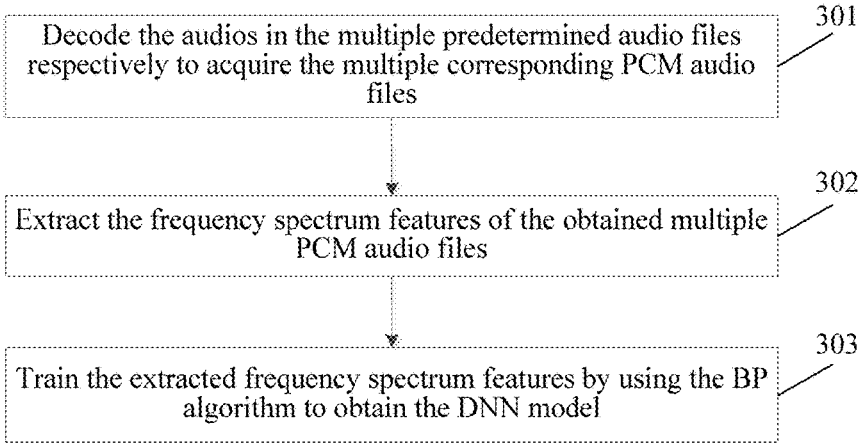
FIG. 3 is a flow diagram of a method to obtain a Deep Neural Networks (DNN) model through training according an exemplary embodiment.

FIG. 3 is a flow diagram of the method to obtain the DNN model through training according an exemplary embodiment. As shown in FIG. 3, the method to obtain the DNN model through training according an exemplary embodiment may include the following steps:

Step S301: Decode the audios in the multiple predetermined audio files respectively to acquire the corresponding multiple Pulse Code Modulation (PCM) audio files.

Here the multiple predetermined audio files may be N original songs and corresponding N a cappella songs thereof selected from a song library of WeSing. N may be a positive integer and may be greater than 2,000 for the follow-up training. There have been tens of thousands of songs with both original and high-quality a cappella data (the a cappella data is mainly selected by a free scoring system, that is to select the a cappella data with a higher score), so all such songs may be collected, from which 10,000 songs may be randomly selected for follow-up operations (here the complexity and accuracy of the follow-up training are mainly considered for the selection).

All selected original files and corresponding a cappella files are decoded to acquire a pulse code modulation (PCM) audio file of 16 k/16 bit, that is to acquire 10,000 PCM original audios and corresponding 10,000 PCM a cappella audios. If $x_{n1}$, $n1 \in (1 \sim 10000)$ is used to represent the original audios and $y_{n2}$, $n2 \in (1 \sim 10000)$ represents the corresponding a cappella audios, then there may be a one-to-one correspondence between n1 and n2.

Step S302: Extract the frequency spectrum features from the obtained multiple PCM audio files.

Specifically, the following operations are included:

1) Frame the audios. Here, set the frame length as 512 sampling points and the frame shift as 128 sampling points;

2) Weight each frame data by a Hamming window function and perform fast Fourier transform to obtain a 257 dimensional real-domain spectral density and a 255 dimensional virtual-domain spectral density, totaling 512 dimensional feature $z_i$, $i \in (1 \sim 512)$;

3) Calculate the quadratic sum of each real-domain spectral density and the corresponding virtual-domain spectral density thereof;

in other words, it is to calculate $|S_{real}(f)|^2+|S_{virtual}(f)|^2$, where f denotes frequency, $S_{real}(f)$ denotes the real-domain spectral density/energy value corresponding to the frequency f after the Fourier transform, and $S_{virtual}(f)$ denotes the virtual-domain spectral density/energy value corresponding to the frequency f after the Fourier transform, so as to obtain the 257 dimensional feature $t_i$, $i \in (1 \sim 257)$.

4) Calculate the $\log_e$ of the above results to obtain the required 257 dimensional frequency spectrum feature $\ln|S(f)|^2$.

Step S303: Train the extracted frequency spectrum features by using the BP algorithm to obtain the DNN model.

Figure 4:
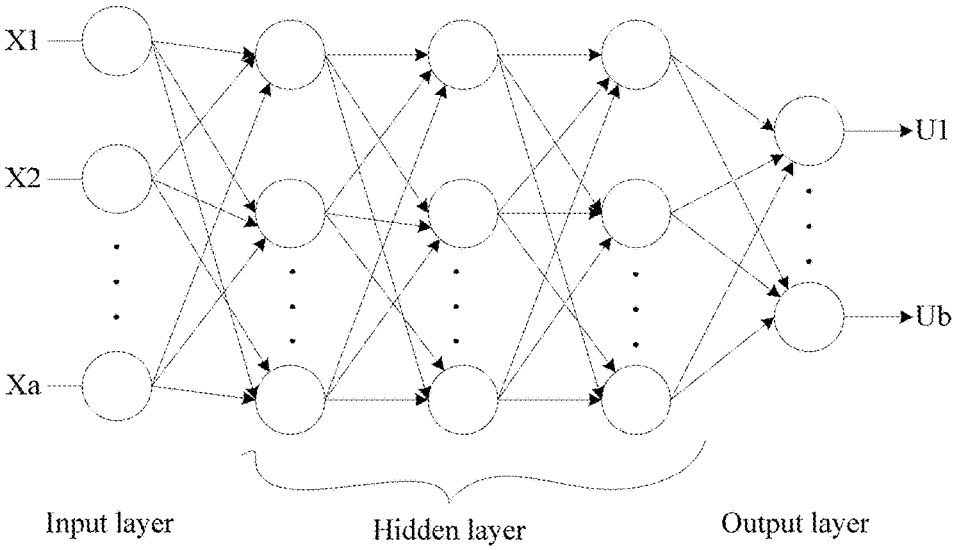
FIG. 4 is a schematic diagram of the DNN model according an exemplary embodiment.

Here, the Error Back Propagation (BP) algorithm is used to train a deep neural network with three hidden layers. As shown in FIG. 4, the number of nodes in each of the three hidden layers is 2048, an input layer is original audio $x_i$, each frame of 257 dimensional feature extends 5 frames forward and then extends 5 frames backward to obtain 11 frames data, totaling 11*257=2827 dimensional feature, i.e. $a \in [1, 2827]$, and the output is the 257 dimensional feature of the frame corresponding to the a cappella audio $y_i$, i.e. $b \in [1, 257]$. After being trained by the BP algorithm, 4 matrices are obtained, including a 2827*2048 dimensional matrix, a 2048*2048 dimensional matrix, a 2048*2048 dimensional matrix and a 2048*257 dimensional matrix.

Exemplary Embodiment 3

Figure 5:
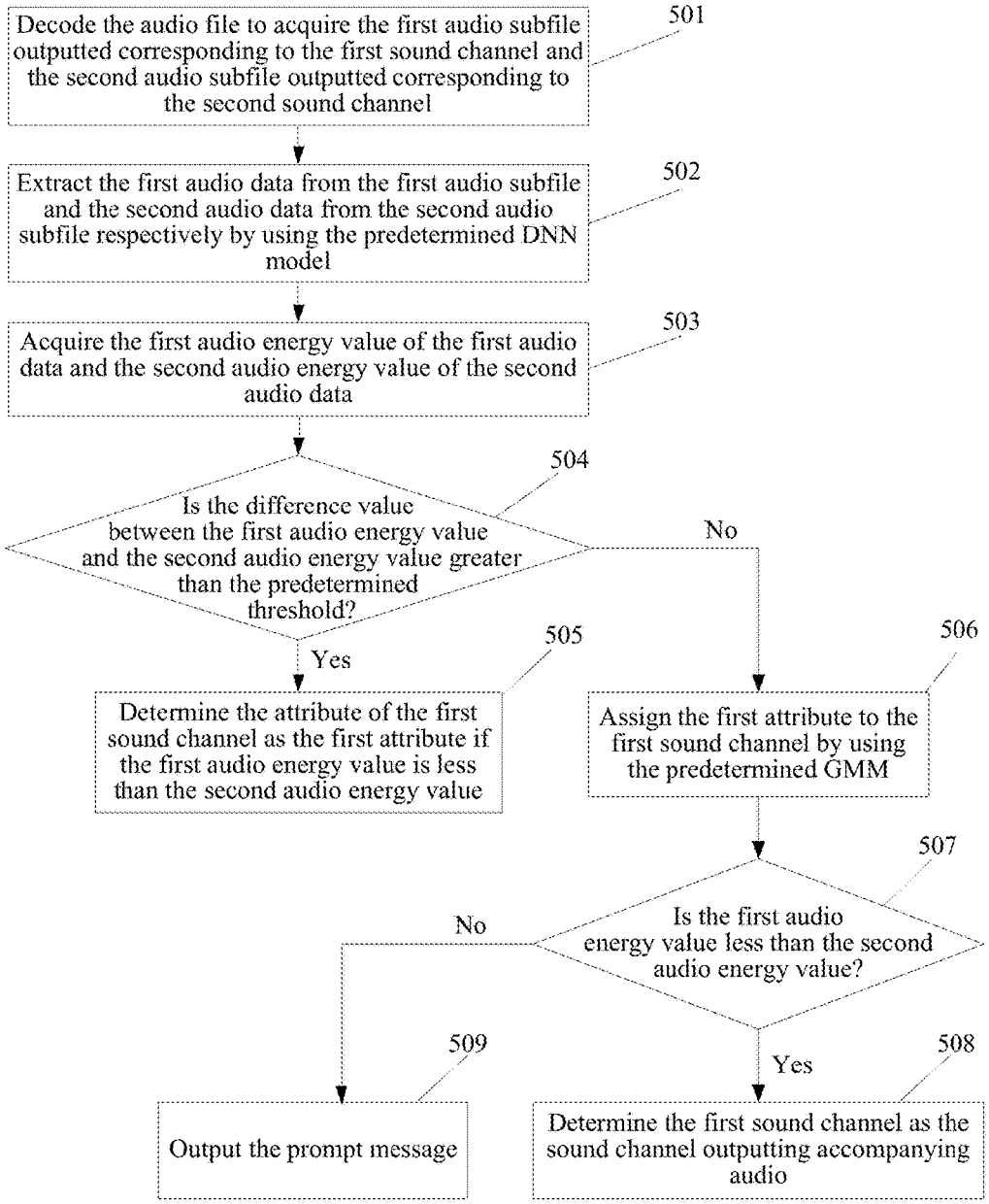
FIG. 5 is a flow diagram of an audio information processing method according an exemplary embodiment.

FIG. 5 is a flow diagram of the audio information processing method according an exemplary embodiment. As shown in FIG. 5, the audio information processing method according an exemplary embodiment may include the following steps:

Step S501: Decode the audio file to acquire the first audio subfile outputted corresponding to the first sound channel and the second audio subfile outputted corresponding to the second sound channel.

The audio file herein (also denoted a first audio file) may be any music file whose accompanying/original sound channels are to be distinguished. If the audio file is a song whose accompanying/original sound channels are to be distinguished, then the first sound channel and the second sound channel may be the left channel and the right channel respectively, and correspondingly, the first audio subfile and the second audio subfile may be the accompanying file and the original file corresponding to the first audio file, respectively. In other words, if the first audio file is a song, then in Step S501, the song is decoded to acquire the accompanying file or original file of the song outputted by the left channel and the original file or accompanying file of the song outputted by the right channel.

Step S502: Extract the first audio data from the first audio subfile and the second audio data from the second audio subfile respectively by using the predetermined DNN model.

Here, the predetermined DNN model may be the DNN model obtained through in-advance training by using the BP algorithm in exemplary embodiment 2 described above or the DNN model obtained through other methods;

The first audio data and the second audio data may have a same attribute, or the two may represent the same attribute. If the two are both human-voice audios, then the human-voice audios are extracted from the first audio subfile and the second audio subfile by using the DNN model obtained through in-advance training. For example, when the first audio file is a song, if the first audio subfile is an accompanying audio file and the second audio subfile is an original audio file, then the DNN model is used to extract the human-voice accompanying data from the accompanying audio file and the human a cappella data from the original audio file.

The process of extracting the a cappella data by using the DNN model obtained through training may include the following steps:

1) Decode the audio file of the a cappella data to be extracted to a PCM audio file of 16 k/16 bit;

2) Use the method provided in step S302 of exemplary embodiment 2 to extract the frequency spectrum features;

3) Suppose that the audio file has a total of m frames. Each frame feature extends 5 frames forward and backward respectively to obtain 11*257 dimensional feature (the operation is not performed for the first 5 frames and the last 5 frames of the audio file), and multiple the input feature by the matrix in each layer of the DNN model obtained through training in the embodiment 2 to finally obtain a 257 dimensional output feature and then obtain m−10 frame output feature. The first frame extends 5 frames forward and the last frame extends 5 frames backward to obtain m frame output result;

4) Calculate the $e^x$ of each dimensional feature of each frame to obtain the 257 dimensional feature $k_i$, $i \in (1 \sim 257)$;

5) Use the formula $$z_i \cdot \sqrt{\frac{k_j}{t_j}}$$

to obtain 512 dimensional frequency spectrum feature, where i denotes 512 dimensions, j denotes the corresponding frequency band of i, which is 257, and j may correspond to one or two i, and variables z and t correspond to $z_i$ and $t_i$ obtained in step 2) respectively;

6) Perform inverse Fourier transform on the above 512 dimensional feature to obtain the time-domain feature, and connect the time-domain features of all frames together to obtain the required a cappella file.

Step S503: Acquire the first audio energy value of the first audio data and the second audio energy value of the second audio data.

For example, the first audio energy value may be calculated from the first audio data, and the second audio energy value may be calculated from the second audio data. The first audio energy value may be the average audio energy value of the first audio data, and the second audio energy value may be the average audio energy value of the second audio data. In practical application, different methods may be used to acquire the average audio energy value corresponding to the audio data. For example, the audio data is composed of multiple sampling points, and each sampling point generally corresponds to a value between 0 and 32767, and the average value of all sampling point values is taken as the average audio energy value corresponding to the audio data. In this way, the average value of all sampling points of the first audio data may be taken as the first audio energy value, and the average value of all sampling points of the second audio data may be taken as the second audio energy value.

Step S504: Determine whether the difference value between the first audio energy value and the second audio energy value is greater than the predetermined threshold or not. If yes, proceed to step S505; otherwise, proceed to step S506.

In practical application, for a song, if there are few human-voice accompaniments in the song, then correspondingly, the audio energy value corresponding to the accompanying file of the song will be small, while the audio energy value corresponding to the a cappella file of the song will be large. Therefore, a threshold (i.e. audio energy difference threshold) may be used. The audio energy difference threshold may be predetermined. Specifically, the threshold may be set experimentally according to the actual use. For example, the threshold may be set as 486. If the difference value between the first audio energy value and the second audio energy value is greater than the audio energy difference threshold, the sound channel corresponding to the sound channel whose audio energy value is smaller is determined as the accompanying sound channel.

Step S505: if the first audio energy value is less than the second audio energy value, then determine the attribute of the first sound channel as the first attribute, and if the second audio energy value is less than the first audio energy value, then determine the attribute of the second sound channel as the first attribute.

Here, determining the first audio energy value and the second audio energy value. If the first audio energy value is less than the second audio energy value, then determine the attribute of the first sound channel as the first attribute and the attribute of the second sound channel as the second attribute, that is to determine the first sound channel as the sound channel outputting accompanying audios and the second sound channel as the sound channel outputting original audios. If the second audio energy value is less than the first audio energy value, then determine the attribute of the second sound channel as the first attribute and the attribute of the first sound channel as the second attribute, that is to determine the second sound channel as the sound channel outputting accompanying audios and the first sound channel as the sound channel outputting original audios.

In this way, whichever is smaller of the first audio subfile or the second audio subfile (corresponding to the first audio energy value or the second audio energy value, respectively), may be determined as the audio file that meets the particular attribute requirements, and the sound channel corresponding to the audio subfile that meets the particular attribute requirements as the sound channel that meets the particular requirements. The audio file that meets the particular attribute requirements is the accompanying audio file corresponding to the first audio file, and the sound channel that meets the particular requirements is the sound channel where the outputted audio of the first audio file is the accompanying audio in the first sound channel and the second sound channel.

Step S506: Assign attribute to the first sound channel and/or the second sound channel by using the predetermined GMM.

Figure 6:
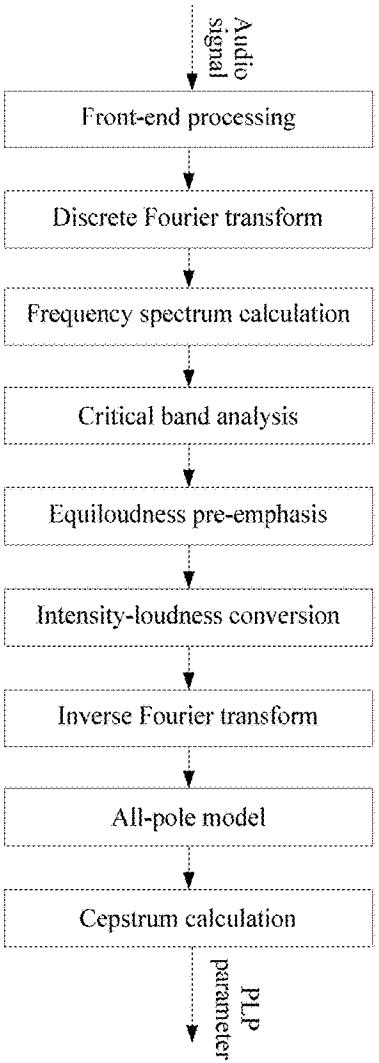
FIG. 6 is a flow diagram of Perceptual Linear Predictive (PLP) parameter extraction according an exemplary embodiment.

Here, the predetermined GMM model is obtained through in-advance training, and the specific training process includes the following:

extract the 13 dimensional Perceptual Linear Predictive (PLP) characteristic parameters of the multiple predetermined audio files; and the specific process of extracting the PLP parameters is shown in FIG. 6. As shown in FIG. 6, perform front-end processing on an audio signal (i.e. audio file), and then perform discrete Fourier transform, then processing such as frequency band calculation, critical band analysis, equiloudness pre-emphasis and intensity-loudness conversion, and then perform inverse Fourier transform to generate an all-pole model, and calculate the cepstrum to obtain the PLP parameters.

Calculate the first order difference and the second order difference by using the extracted PLP characteristic parameters, totaling 39 dimensional features. Use the Expectation Maximization (EM) algorithm to obtain the GMM model which can preliminarily distinguish the accompanying audios from the a cappella audios through training based on the extracted PLP characteristic parameters. However, in practical application, an accompanying GMM model may be trained, and a similarity calculation may be performed between the model and the audio data to be distinguished, and the group of audio data with high similarity is exactly the accompanying audio data. In the present embodiment, by assigning attribute to the first sound channel and/or the second sound channel by using the predetermined GMM, which one of the first sound channel and the second sound channel is the sound channel that meets the particular attribute requirements may be preliminarily determined. For example, by performing a similarity calculation between the predetermined GMM model and the first and second audio data, assign or determine the sound channel corresponding to the audio data with high similarity as the sound channel outputting accompanying audios.

In this way, after determining which one of the first sound channel and the second sound channel is the sound channel outputting accompanying audio by using the predetermined GMM model, the determined sound channel is the sound channel that preliminarily meets the particular attribute requirements.

Step S507: Determine the first audio energy value and the second audio energy value. If the first attribute is assigned to the first sound channel and the first audio energy value is less than the second audio energy value, or the first attribute is assigned to the second sound channel and the second audio energy value is less than the first audio energy value, proceed to step S508; otherwise proceed to step S509.

In other words, determine whether the audio energy value corresponding to the sound channel that preliminarily meets the particular attribute requirements is less than the audio energy value corresponding to the other sound channel or not. If yes, proceed to step S508; otherwise proceed to step S509. The audio energy value corresponding to the sound channel that preliminarily meets the particular attribute requirements is exactly the audio energy value of the audio file outputted by the sound channel.

Step S508: If the first attribute is assigned to the first sound channel and the first audio energy value is less than the second audio energy value, determine the attribute of the first sound channel as the first attribute and the attribute of the second sound channel as the second attribute, that is to determine the first sound channel as the sound channel outputting accompanying audio and the second sound channel as the sound channel outputting original audio. If the first attribute is assigned to the second sound channel and the second audio energy value is less than the first audio energy value, determine the attribute of the second sound channel as the first attribute and the attribute of the first sound channel as the second attribute, that is to determine the second sound channel as the sound channel outputting accompanying audio and the first sound channel as the sound channel outputting original audio.

In this way, the sound channel that preliminarily meets the particular attribute requirements may be determined as the sound channel that meets the particular attribute requirements which is the sound channel outputting accompanying audio.

In some exemplary embodiments, the method may further include the following steps after Step S508:

label the sound channel that meets the particular attribute requirements;

switch between sound channels based on the labeling of the sound channel that meets the particular attribute requirements if it is determined to switch the sound channels;

for example, the sound channel that meets the particular attribute requirements may be the sound channel outputting accompanying audio. After the sound channel outputting accompanying audio (such as the first sound channel) is determined, the sound channel is labeled as the accompanying audio sound channel. In this way, it is possible to switch between accompaniments and originals based on the labeled sound channel. For example, a user may switch between accompaniments and originals based on the labeled sound channel when the user is singing karaoke;

alternatively, adjust the sound channel that meets the particular attribute requirements as the first sound channel or the second sound channel uniformly; in this way, all sound channels outputting accompanying audios/original audios may be unified for the convenience of unified management.

Step S509: Output the prompt message.

Here, the prompt message may be used to prompt the user that the corresponding sound channel outputting accompanying audio of the first audio file cannot be distinguished, so that the user can confirm that the corresponding sound channel outputs accompanying audio manually.

For example, if the first attribute is assigned to the first sound channel but the first audio energy value is not less than the second audio energy value, or the first attribute is assigned to the second sound channel but the second audio energy value is not less than the first audio energy value, then the attributes of the first sound channel and the second sound channel need to be confirmed artificially.

In applying the above exemplary embodiment, based on the features of music files, firstly extract the human-voice component from the music by using the trained DNN model, and then obtain the final classification result through comparison of dual-channel human-voice energy. The accuracy of the final classification may reach 99% or above.

Exemplary Embodiment 4

Figure 7:
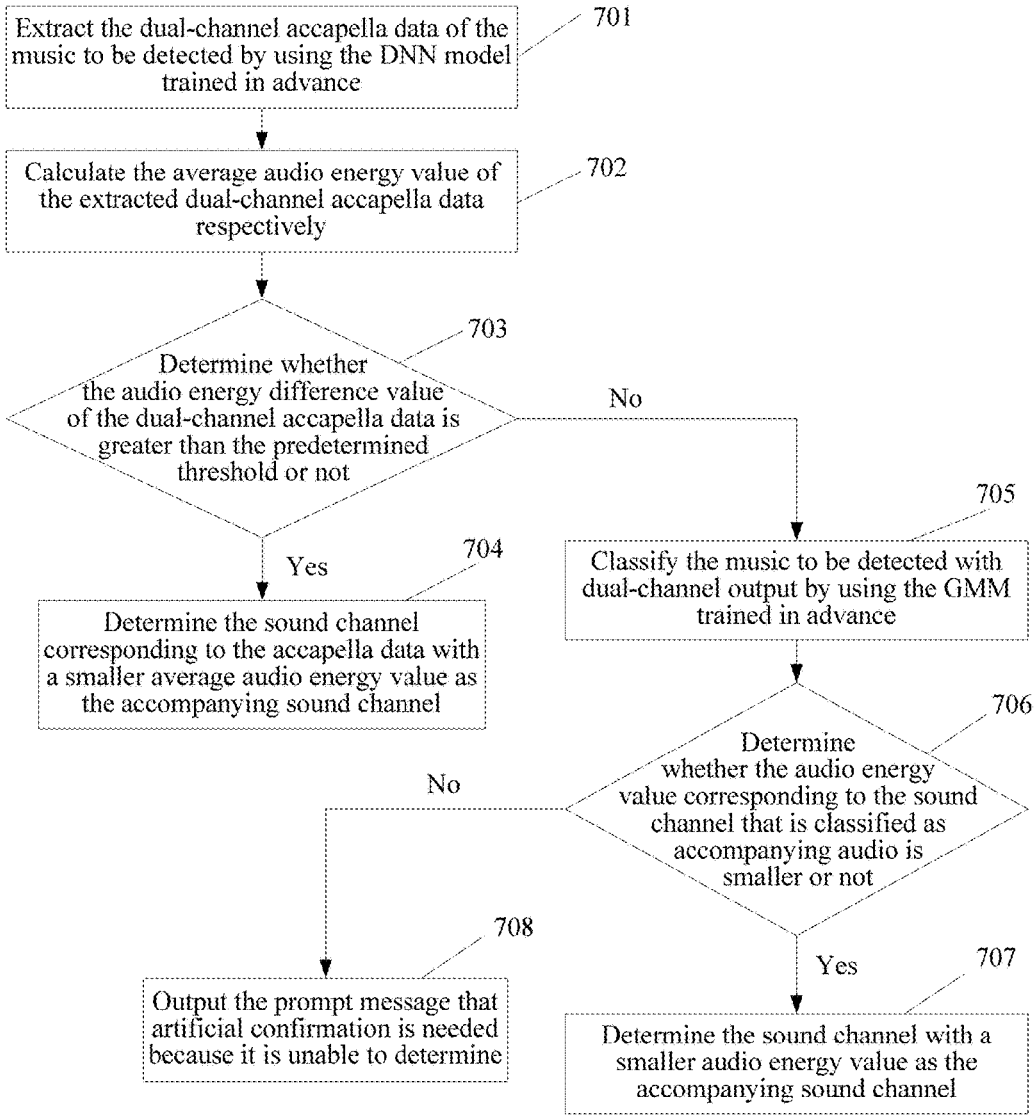
FIG. 7 may be a flow diagram of an audio information processing method according an exemplary embodiment.

FIG. 7 is a flow diagram of an audio information processing method according an exemplary embodiment. As shown in FIG. 7, the audio information processing method according an exemplary embodiment may include the following steps:

Step S701: Extract the dual-channel a cappella data (and/or human-voice accompanying data) of the music to be detected by using the DNN model trained in advance.

Figure 8:
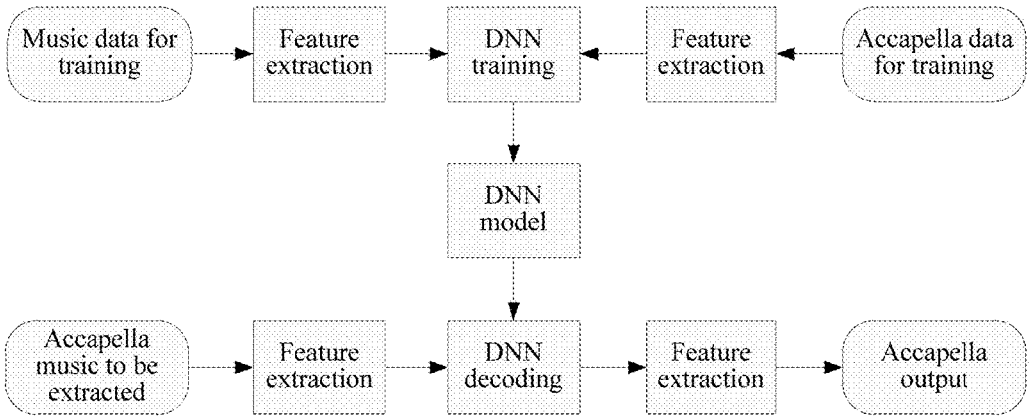
FIG. 8 is a schematic diagram of an a cappella data extraction process according an exemplary embodiment.

A specific process of extracting the a cappella data is shown in FIG. 8. As shown in FIG. 8, firstly extract the features of the a cappella data for training and the music data for training, and then perform DNN training to obtain the DNN model. Extract the features of the a cappella music to be extracted and perform DNN decoding based on the DNN model, then extract the features again, and finally obtain the a cappella data.

Step S702: Calculate the average audio energy value of the extracted dual-channel a cappella (and/or human-voice accompanying) data respectively.

Step S703: Determine whether the audio energy difference value of the dual-channel a cappella (and/or human-voice accompanying) data is greater than the predetermined threshold or not. If yes, proceed to step S704; otherwise, proceed to step S705.

Step S704: Determine the sound channel corresponding to the a cappella (and/or human-voice accompanying) data with a smaller average audio energy value as the accompanying sound channel.

Step S705: Classify the music to be detected with dual-channel output by using the GMM trained in advance.

Step S706: Determine whether the audio energy value corresponding to the sound channel that is classified as accompanying audio is smaller or not. If yes, proceed to step S707; otherwise, proceed to step S708.

Step S707: Determine the sound channel with a smaller audio energy value as the accompanying sound channel.

Step S708: Output the prompt message to use manual confirmation.

Figure 9:
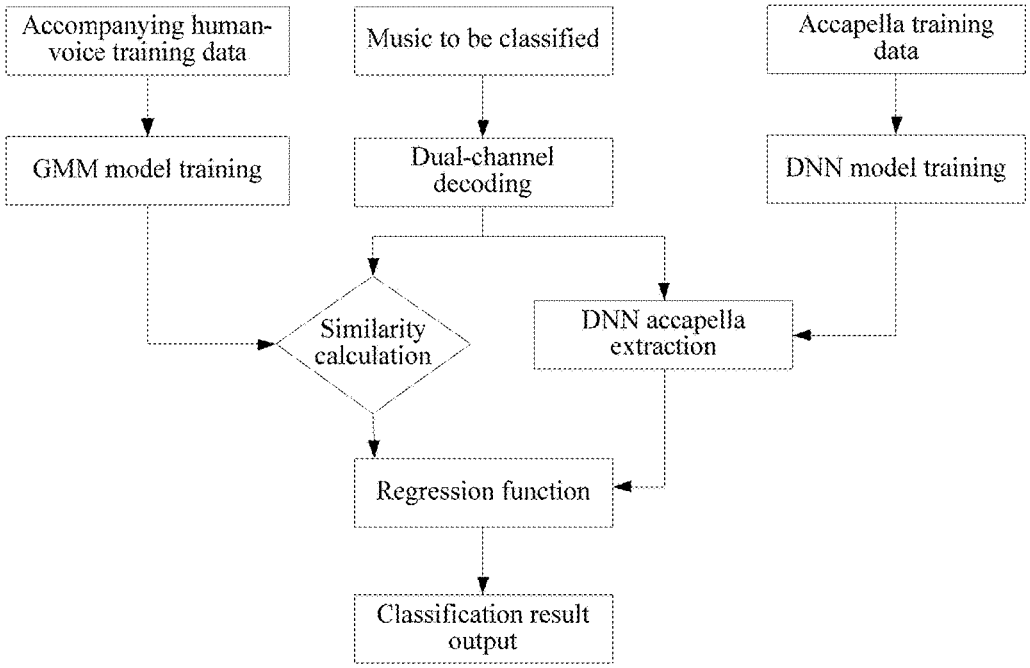
FIG. 9 is a flow diagram of an audio information processing method according an exemplary embodiment.

When the audio information processing method according to the exemplary embodiment is implemented practically, the dual-channel a cappella (and/or human-voice accompanying) data may be extracted while the accompanying audio sound channel is determined by using the GMM, and then a regression function is used to execute the above steps 703-708. It should be noted that the operations in step S705 have been executed in advance, so such operations may be skipped when the regression function is used, as shown in FIG. 9. Referring to FIG. 9, conduct dual-channel decoding on the music to be classified (i.e. music to be detected). At the same time, use the a cappella training data to obtain the DNN model through training and use the accompanying human-voice training data to obtain the GMM model through training. Then, conduct similarity calculation by using the GMM model and extract the a cappella data by using the DNN model, and operate by using the regression function as mentioned above to finally obtain the classification results.

Exemplary Embodiment 5

Figure 10:
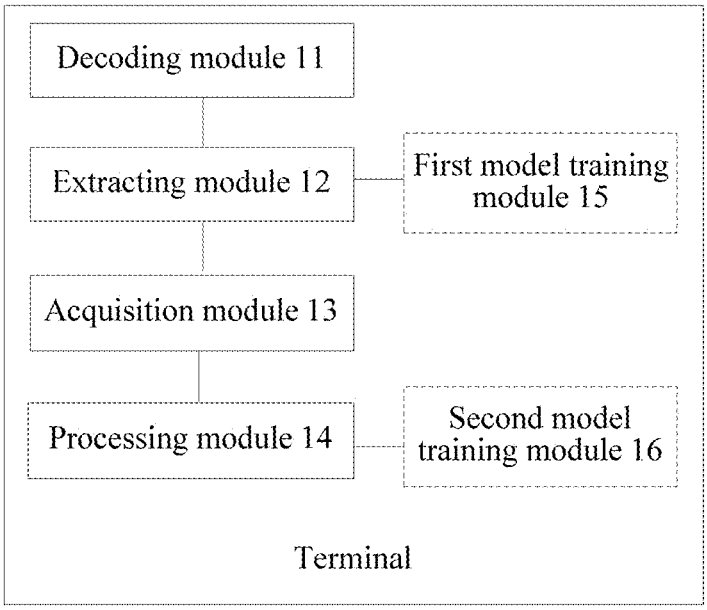
FIG. 10 is a structural diagram of an audio information processing apparatus according an exemplary embodiment.

FIG. 10 is a structural diagram of the composition of the audio information processing apparatus according an exemplary embodiment. As shown in FIG. 10, the composition of the audio information processing apparatus according an exemplary embodiment includes a decoding module 11, an extracting module 12, an acquisition module 13 and a processing module 14;

the decoding module 11 being configured to decode the audio file (i.e. the first audio file) to acquire the first audio subfile outputted corresponding to first sound channel and the second audio subfile outputted corresponding to the second sound channel;

the extracting module 12 being configured to extract the first audio data from the first audio subfile and the second audio data from the second audio subfile;

the acquisition module 13 being configured to acquire the first audio energy value of the first audio data and the second audio energy value of the second audio data;

the processing module 14 being configured to determine the attribute of at least one of the first sound channel and the second sound channel based on the first audio energy value and the second audio energy value.

The first audio data and the second audio data may have a same attribute. For example, the first audio data may correspond to the human-voice audio outputted by the first sound channel and the second audio data may correspond to the human-voice audio outputted by the second sound channel;

further, the processing module 14 may be configured to determine which one of the first sound channel and the second sound channel is the sound channel outputting accompanying audio based on the first audio energy value of the human-voice audio outputted by the first sound channel and the second audio energy value of the human-voice audio outputted by the second sound channel.

In some exemplary embodiments, the apparatus may further comprise a first model training module 15 configured to extract the frequency spectrum features of the multiple predetermined audio files respectively;

train the extracted frequency spectrum features by using the error back propagation (BP) algorithm to obtain the DNN model;

correspondingly, the extracting module 12 may be further configured to extract the first audio data from the first audio subfile and the second audio data from the second audio subfile respectively by using the DNN model.

In some exemplary embodiments, the processing module 14 may be configured to determine the difference value between the first audio energy value and the second audio energy value. If the difference value is greater than the threshold (e.g. an audio energy difference threshold) and the first audio energy value is less than the second audio energy value, then determine the attribute of the first sound channel as the first attribute and the attribute of the second sound channel as the second attribute, that is to determine the first sound channel as the sound channel outputting accompanying audio and the second sound channel as the sound channel outputting original audio. On the contrary, if the difference value between the first audio energy value and the second audio energy value is greater than the threshold and the second audio energy value is less than the first audio energy value, then determine the attribute of the second sound channel as the first attribute and the attribute of the first sound channel as the second attribute, that is to determine the second sound channel as the sound channel outputting accompanying audio and the first sound channel as the sound channel outputting original audio.

In this way, when the processing module 14 detects that the difference value between the first audio energy value and the second audio energy value is greater than the audio energy difference threshold, the first audio subfile or the second audio subfile corresponding to the first audio energy value or the second audio energy value (whichever is smaller) is determined as the audio file that meets the particular attribute requirements, and the sound channel corresponding to the audio subfile that meets the particular attribute requirements as the sound channel that meets the particular requirements;

alternatively, when the processing module 14 detects that the difference value between the first audio energy value and the second audio energy value is not greater than the audio energy difference threshold, the classification method is used to assign attribute to at least one of the first sound channel and the second sound channel, so as to preliminarily determine which one of the first sound channel and the second sound channel is the sound channel that meets the particular attribute requirements.

In some exemplary embodiments, the apparatus may further comprise a second model training module 16 being configured to extract the Perceptual Linear Predictive (PLP) characteristic parameters of multiple audio files;

obtain the Gaussian Mixture Model (GMM) through training by using the Expectation Maximization (EM) algorithm based on the extracted PLP characteristic parameters;

correspondingly, the processing module 14 may be further configured to assign an attribute to at least one of the first sound channel and the second sound channel by using the GMM obtained through training, so as to preliminarily determine the first sound channel or the second sound channel as the sound channel that preliminarily meets the particular attribute requirements.

Further, the processing module 14 may be configured to determine the first audio energy value and the second audio energy value. If the first attribute is assigned to the first sound channel and the first audio energy value is less than the second audio energy value, or the first attribute is assigned to the second sound channel and the second audio energy value is less than the first audio energy value. This is also to preliminarily determine whether the audio energy value corresponding to the sound channel that meets the particular attribute requirements is less than the audio energy value corresponding to the other sound channel or not;

if the result shows that the audio energy value corresponding to the sound channel that preliminarily meets the particular attribute requirements is less than the audio energy value corresponding to the other sound channel, determine the sound channel that preliminarily meets the particular attribute requirements as the sound channel that meets the particular attribute requirements.

In some exemplary embodiments, the processing module 14 may be further configured to output a prompt message when the result shows that the audio energy value corresponding to the sound channel that preliminarily meets the particular attribute requirements is not less than the audio energy value corresponding to the other sound channel.

The decoding module 11, the extracting module 12, the acquisition module 13, the processing module 14, the first model training module 15 and the second model training module 16 in the audio information processing apparatus may be achieved through a Central Processing Unit (CPU), a Digital Signal Processor (DSP), a Field Programmable Gate Array (FPGA) or an Application Specific Integrated Circuit (ASIC) in the apparatus.

Figure 11:
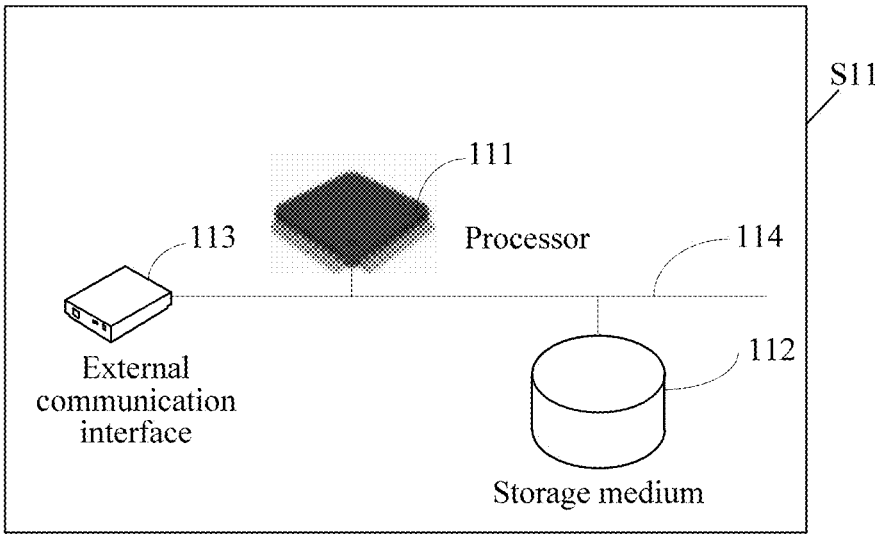
FIG. 11 is a structural diagram of a hardware composition of an audio information processing apparatus according an exemplary embodiment.

FIG. 11 is a structural diagram of the hardware composition of the audio information processing apparatus according an exemplary embodiment. As an example of a hardware implementation, the apparatus S11 is shown as FIG. 11. The apparatus S11 may include a processor 111, a storage medium 112 and at least one external communication interface 113; and the processor 111, the storage medium 112 and the external communication interface 113 may be connected through a bus 114.

It should be noted that the audio information processing apparatus according an exemplary embodiment may be a mobile phone, a desktop computer, a PC or an all-in-one machine. The audio information processing method may also be achieved through the operations of a server.

It should be noted that the above descriptions related to the apparatus are similar to those related to the method, so the descriptions of the advantageous effects of the same method are omitted herein. Please refer to the descriptions of the exemplary embodiments of the method discussed above for the technical details that are not disclosed in the exemplary embodiments of the apparatus.

The audio information processing apparatus according an exemplary embodiment may be a terminal or a server. Similarly, the audio information processing method according to an exemplary embodiment is not limited to being used in the terminal, instead, the audio information processing method may also be used in a server such as a web server or a server corresponding to music application software (e.g. WeSing software). Please refer to the above descriptions of the exemplary embodiments for specific processing procedures, and details are omitted herein.

A person skilled in the art may understand that partial or all steps to achieve the above exemplary embodiments of the method may be implemented by the related hardware executing computer program code. The foregoing computer program code may be stored in a computer-readable storage medium, and a computer may execute the steps including the above exemplary embodiments during execution; and the foregoing storage medium may include a mobile storage device, a Random Access Memory (RAM), a Read-Only Memory (ROM), a disk, a disc or other media that can store program codes.

Alternatively, if the above integrated unit of the present application is achieved in the form of software functional module(s) and is sold or used as an independent product, then the software functional module(s) may also be stored in a computer-readable storage medium. On this basis, the technical solution according exemplary embodiments essentially or the part contributing to the related technology may be embodied in the form of a software product. The computer software product is stored in a storage medium and includes several instructions used to allow a computer device (which may be a personal computer, a server or a network device) to execute the whole or part of the method provided by each exemplary embodiment of the present application. The foregoing storage medium includes a mobile storage device, an RAM, an ROM, a disk, a disc or other media that can store program codes.

The foregoing descriptions are merely specific exemplary embodiments, but the protection scope of the present application is not limited thereto. Any changes or replacements within the technical scope disclosed in the present application made by those skilled in the art should fall within the scope of protection of the present application. Therefore, the protection scope of the present application is provided by the appended claims.

What is claimed is:

1. A method comprising:

decoding a first audio file to acquire a first audio subfile corresponding to a first sound channel and a second audio subfile corresponding to a second sound channel, where one of the first sound channel and the second sound channel includes original audio, and the other one of the first sound channel and the second sound channel includes accompanying audio;

extracting first audio data from the first audio subfile;

extracting second audio data from the second audio subfile;

acquiring a first audio energy value of the first audio data;

acquiring a second audio energy value of the second audio data;

determining an attribute of at least one of the first sound channel and the second sound channel based on the first audio energy value and the second audio energy value; and determining which one of the first and second sound channels includes the accompanying audio based on the attribute that is determined.

2. The method according to claim 1, further comprising:

extracting frequency spectrum features of a plurality of second audio files, respectively; and training the frequency spectrum features by using an error back propagation (BP) algorithm to obtain a deep neural networks (DNN) model, wherein the first audio data is extracted from the first audio subfile by using the DNN model, wherein the second audio data is extracted from the second audio subfile by using the DNN model.

3. The method according to claim 1, wherein the determining the attribute includes:

determining a difference value between the first audio energy value and the second audio energy value;

determining the attribute of the first sound channel as a first attribute in response to the difference value being greater than a threshold and the first audio energy value being less than the second audio energy value.

4. The method according to claim 1, wherein the determining the attribute includes:

determining a difference value between the first audio energy value and the second audio energy value; and assigning an attribute to at least one of the first sound channel and the second sound channel by using a classification method in response to the difference value being less than or equal to a threshold value.

5. The method according to claim 4, further comprising:

extracting Perceptual Linear Predictive (PLP) characteristic parameters from a plurality of second audio files; and obtaining a Gaussian Mixture Model (GMM) through training by using an EM algorithm based on the PLP characteristic parameters, wherein the attribute may be assigned by using the GMM obtained through training.

6. The method according to claim 4, wherein the method further comprises, in response to the attribute being assigned to the first sound channel:

determining whether the first audio energy value is less than the second audio energy value;

determining the attribute of the first sound channel as a first attribute in response to the first audio energy value being less than the second audio energy value.

7. The method according to claim 3, wherein, the first audio data is human-voice audio corresponding to the first sound channel, and the second audio data is human-voice audio corresponding to the second sound channel, and wherein the determining the attribute of the first sound channel as the first attribute includes:

determining the first sound channel as a sound channel outputting accompanying audio.

8. The method according to claim 1, further comprising:

labeling the attribute;

determining whether to switch between the first sound channel and the second sound channel; and switching between the first sound channel and the second sound channel based on the labeling in response to determining to switch between the first sound channel and the second sound channel.

9. The method according to claim 1, wherein the first audio data has a same attribute as an attribute of the second audio data.

10. The method according to claim 1, wherein the attribute indicates that the sound channel is an accompaniment audio or an original audio.

11. An apparatus comprising:

at least one memory configured to store computer program code; and at least one processor configured to access the at least one memory and operate according to the computer program code, said computer program code including:

decoding code configured to cause the at least one processor to decode an audio file to acquire a first audio subfile corresponding to a first sound channel and a second audio subfile corresponding to a second sound channel, where one of the first sound channel and the second sound channel includes original audio, and the other one of the first sound channel and the second sound channel includes accompanying audio;

extracting code configured to cause the at least one processor to extract first audio data from the first audio subfile and second audio data from the second audio subfile;

acquisition code configured to cause the at least one processor to acquire a first audio energy value of the first audio data and a second audio energy value of the second audio data;

processing code configured to cause the at least one processor to determine an attribute of at least one of the first sound channel and the second sound channel based on the first audio energy value and the second audio energy value; and determining code configured to cause the at least one processor to determine which one of the first and second sound channels includes the accompanying audio based on the attribute that is determined.

12. The apparatus according to claim 11, wherein the computer program code further comprises first model training code configured to cause the at least one processor to:

extract frequency spectrum features of multiple other audio files respectively;

train the extracted frequency spectrum features by using an error back propagation (BP) algorithm to obtain a deep neural networks (DNN) model, wherein the extracting code is configured to cause the at least one processor to extract the first audio data from the first audio subfile and the second audio data from the second audio subfile respectively by using the DNN model.

13. The apparatus according to claim 11, wherein the at least one processor is further configured to:

determine a difference value between the first audio energy value and the second audio energy value; and determine the attribute of the first sound channel as a first attribute in response to the difference value being greater than a threshold value and the first audio energy value being less than the second audio energy value.

14. The apparatus according to claim 11, wherein the at least one processor is configured to:

determine a difference value between the first audio energy value and the second audio energy value; and assign an attribute to at least one of the first sound channel and the second sound channel by using a classification method in response to the difference value being not greater than a threshold.

15. The apparatus according to claim 14, wherein the computer program code further comprises second model training code configured to cause the at least one processor to:

extract Perceptual Linear Predictive (PLP) characteristic parameters of multiple other audio files; and obtain a Gaussian Mixture Model (GMM) through training by using an Expectation Maximization (EM) algorithm based on the extracted PLP characteristic parameters, wherein the processing code is further configured to cause at least one of the at least one processor to:

assign the attribute to at least one of the first sound channel and the second sound channel by using the GMM obtained through training.

16. The apparatus according to claim 14, wherein, in response to the first attribute being assigned to the first sound channel, the at least one processor is configured to:

determine whether the first audio energy value is less than the second audio energy value; and determine the attribute of the first sound channel as the first attribute in response to the first audio energy value being determine to be less than the second audio energy value.

17. The apparatus according to claim 13, wherein, the first audio data is a first human-voice audio corresponding to the first sound channel, and the second audio data is a second human-voice audio corresponding to the second sound channel, wherein, to determine the attribute of the first sound channel as the first attribute, the processing code is configured to cause at least one of the at least one processor to determine the first sound channel as the sound channel outputting accompanying audio.

18. The apparatus according to claim 11, wherein the at least one processor is further configured to:

label the attribute;

determine whether to switch between the first sound channel and the second sound channel; and switch between the first sound channel and the second sound channel based on the labeling in response to determining to switch between the first sound channel and the second sound channel.

19. The apparatus according to claim 11, wherein the first audio data has the same attribute as the attribute of the second audio data.

20. A non-transitory computer-readable storage medium that stores computer program code that, when executed by a processor of a calculating apparatus, causes the calculating apparatus to perform:

decoding an audio file to acquire a first audio subfile outputted corresponding to a first sound channel and a second audio subfile outputted corresponding to a second sound channel where one of the first sound channel and the second sound channel includes original audio, and the other one of the first sound channel and the second sound channel includes accompanying audio;

extracting first audio data from the first audio subfile;

extracting second audio data from the second audio subfile;

acquiring a first audio energy value of the first audio data;

acquiring a second audio energy value of the second audio data;

determining the attribute of at least one of the first sound channel and the second sound channel based on the first audio energy value and the second audio energy value; and determining which one of the first and second sound channels includes the accompanying audio based on the attribute that is determined.

* * * * *